United States Patent [19]

Johnson et al.

[11] Patent Number: 4,735,156

[45] Date of Patent: Apr. 5, 1988

[54] ROTARY COMBUSTOR FOR BURNING MUNICIPAL SOLID WASTE

[75] Inventors: Joel W. Johnson, Newport Beach; John T. Healy, Irvine, both of Calif.

[73] Assignee: Westinghouse Electric Corp., Pittsburgh, Pa.

[21] Appl. No.: 331

[22] Filed: Jan. 5, 1987

[51] Int. Cl.[4] ..... F27B 7/38

[52] U.S. Cl. ..... 110/246; 110/234; 110/257; 432/116

[58] Field of Search ..... 110/165 R, 233, 234, 110/235, 246, 255, 257, 258, 259, 267, 268, 275, 276, 277, 298, 327, 328; 122/235 R, 235 A, 235 C, 235 K, 235 N, 511; 432/103, 116

[56] References Cited

U.S. PATENT DOCUMENTS

| | | | |
|---|---|---|---|
| 3,822,651 | 7/1974 | Harris et al. | 110/246 X |
| 4,002,148 | 1/1977 | Harding | 110/165 R X |
| 4,052,151 | 10/1977 | Reichrt et al. | 110/246 X |
| 4,066,024 | 1/1978 | O'Connor | 110/246 X |
| 4,226,584 | 10/1980 | Ishikawa | 110/246 X |

FOREIGN PATENT DOCUMENTS

| | | | |
|---|---|---|---|
| 2033535 | 1/1971 | Fed. Rep. of Germany | 110/246 |
| 202314 | 11/1964 | Japan | 110/246 |
| 1013708 | 4/1983 | U.S.S.R. | 110/246 |

*Primary Examiner*—Steven E. Warner
*Attorney, Agent, or Firm*—F. J. Baehr, Jr.

[57] ABSTRACT

A rotary combustor formed of water cooled tubes in an inclined cylindrical array with the lower portion being conical so as to reduce the incline at the lower end. The combustor extends into the cooperating furnace, and is formed with openings between the tubes that increase in size toward the lower end.

6 Claims, 2 Drawing Sheets

ROTARY COMBUSTOR FOR BURNING MUNICIPAL SOLID WASTE

This invention relates generally to water cooled kilns and more particularly concerns an improvement on a kind of kiln becoming known as a rotary combustor.

A rotary combustor of the kind generally described in U.S. Pat. No. 3,822,651, issued June 9, 1974, and incorporated specifically herein by reference, has been found very effective in burning municipal solid waste (MSW) while generating useful steam during the process. A characteristic of MSW is that its makeup, in terms of being combustible, varies widely and unpredictably. An advantage of this rotary combustor is that little or no preclassification of the material being burned is necessary. However, if too many large slow burning objects are fed into the combustor, they will not have completed burning in the favorable environment of the combustor and will pile up in the furnace portion of the structure.

It is an object of the invention to provide an improved rotary combustor which has increased burning capacity within the combustor itself. A related object is to provide a rotary combustor of this kind which takes more heat out of the material being burned within the combustor itself so that the associated furnace-boiler need not be oversized.

It is also an object to provide a rotary combustor as acknowledged above that facilitates separation of the ash from the burning material so as to minimize the formation of clinkers which are harder to handle and dispose of.

Another object is to provide a combustor of the foregoing type which is stronger in the critical area where water and steam are transferred to and from the combustor.

Other objects and advantages of the invention will become apparent upon reading the following detailed description and upon reference to the drawings, in which.

Figure 1:
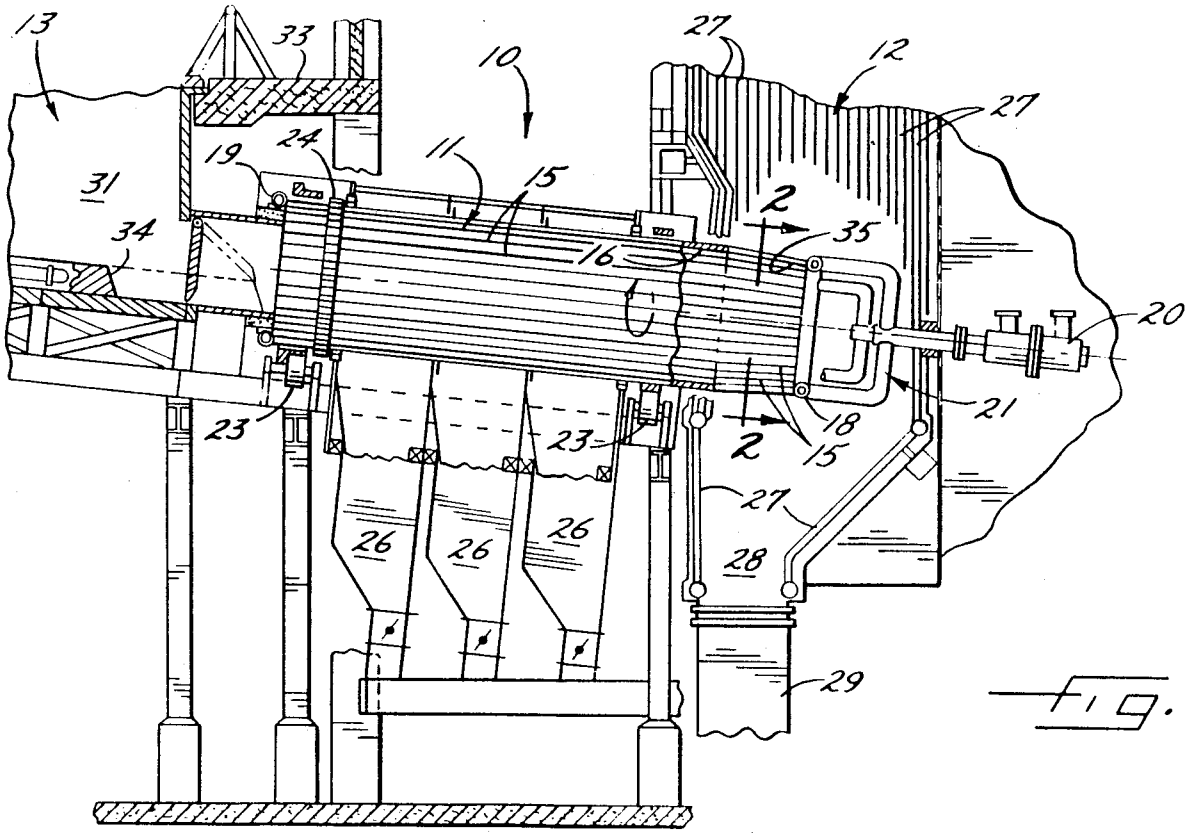
FIG. 1 is a fragmentary vertical section of a rotary combustor and associated structure embodying the invention.
Figure 3:
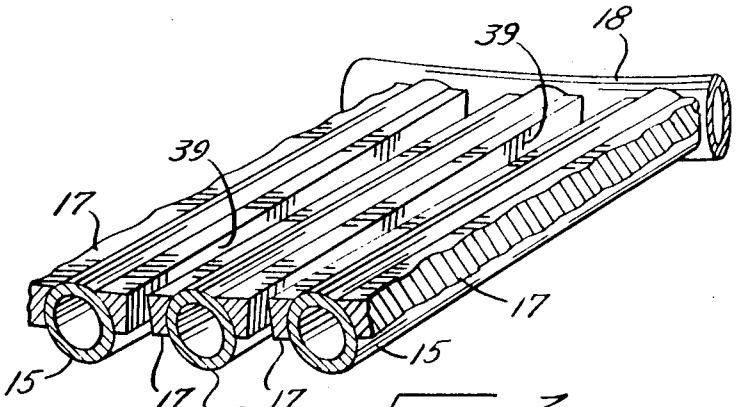
FIG. 3 is a fragmentary perspective showing a portion of the structure otherwise appearing in FIG. 2.
Figure 4:
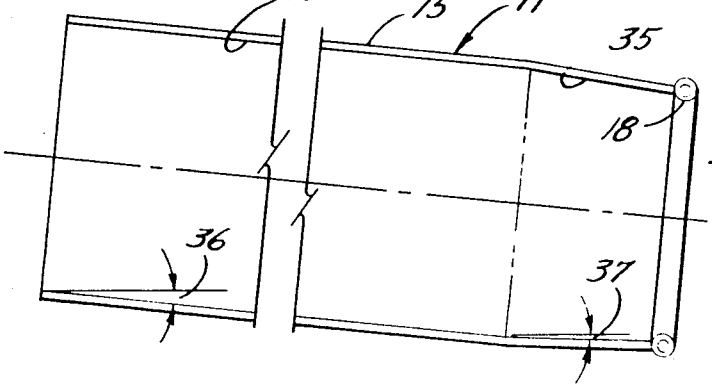
FIG. 4 is a fragmentary diagram showing the angular disposition of the rotary combustor.
Figure 2:
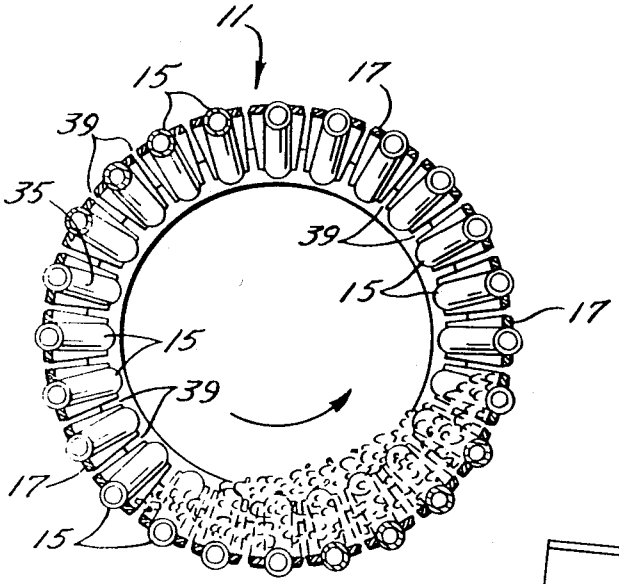
FIG. 2 is a fragmentary section taken approximately along the line 2—2 in FIG. 1.

While the invention will be described in connection with a preferred embodiment, it will be understood that we do not intend to limit the invention to that embodiment.

Turning to the drawing, there is shown a structure 10 embodying the invention and including a rotary combustor 11, a furnace 12 and an arrangement 13 for feeding combustible material into the combustor. The combustor 11 is formed of a plurality of pipes 15 secured together to define an inner generally cylindrical surface 16. The combustor pipes 15 are secured together by perforated strips 17 welded between the pipes so as to provide intermediate openings making the cylindrical surface 16 gas porous. The pipes 15 end in annular header pipes 18 and 19 at each end. A rotary joint 20 feeds water to, and removes steam and hot water from, the combustor through concentric pipes 21. Water is directed to the header pipe 18, and thence to the combustor pipes 15, and steam from the header pipe 19 is carried back through certain ones of the combustor pipes 15 that do not carry water and communicate directly with the steam portion of the pipes 21.

The combustor 11 is mounted for rotation about the axis of the cylindrical surface 16 on support rollers 23 with the axis being tilted so as to have a high and a low end, and the combustor is slowly rotated through a sprocket 24 as shown by the arrow. Combustion air is delivered through the porous combustor walls from wind boxes 26, there being three shown to permit selective control of the air flow along the length of the combustor.

The furnace 12 is defined by a plurality of boiler pipes 27 having a side opening for the combustor and a bottom opening 28 leading to a chute 29 for ashes and nonburnable materials. The arrangement 13 for feeding combustible material includes a chamber 31 beneath the level of a floor 33 from which material can be dumped. A reciprocating ram 34 at the bottom of the chamber 31 positively feeds material into the upper open end of the combustor 11.

As observed above, a basic combustor is further disclosed in said U.S. Pat. No. 3,822,651. A waste feeding ram is disclosed in Ser. No. 000,510, filed Jan. 5, 1987, and a wind box and control is disclosed in Ser. No. 942,570, filed Dec. 15, 1986, both of which U.S. applications are also hereby incorporated by reference.

In accordance with the invention, the lower end of the combustor 11 extends well within the furnace 12, and the pipes 15 at the lower end are formed so that the generally cylindrical surface 16 becomes a conical or more precisely a frustoconical surface 35 at the lower end. Preferably, the axis of the combustor is at an angle 36 of approximately 6° and the lower portion of the conical surface 35 tilts in the same direction but at a lesser angle 37, preferably about 2°. The effect of the lower conical surface 35 of the combustor 11 is to substantially increase the burning residence time of material in the combustor. Large, hard-to-burn objects are detained in the almost level conical surface 35 and they continue to burn. Also, the entire region is within the furnace 12 so slowly burning material is not simply dumped on a grate in the furnace but rather continues to be agitated by the slowly turning combustor. Also, heat from combustion and hot gases in the furnace continue to be drawn into the pipes 15 of the combustor so as to lessen the need for a large furnace.

In carrying out the invention, the intermediate openings in the strips 17 securing the pipes 15 increase in size at the lower end of the combustor and, in the illustrated form, openings 39 taper from narrow slots near the start of the conical surface 35 to virtually the full width of the spacing of the pipes 15 at the header 18. This configuration permits ash to fall quickly into the chute 29 before lengthy exposure of the ash to continued heat forms large, hard-to-handle clinkers. As the openings 39 widen, only larger items are retained by the conical surface 35. While not illustrated, a second hopper could be provided beneath the open lower end of the combustor 11 to receive large, nonburnable objects and thus separate such objects from the ash falling through the openings 39 into the chute 29.

It can thus be seen that the combustor 11 provides increased burning capacity in the sense that added residence time is provided for hard-to-burn objects at the lower end of the combustor. With the lower end of the combustor being within the furnace, more heat is extracted by the combustor itself so that the associated furnace structure need not be sized to absorb that heat.

To obviate the formation of clinkers which are somewhat difficult to handle and dispose of, ashes are promptly dropped through the openings 39 so that they are not subject to continued heat causing fusion and clinker formation.

A collateral advantage of extending the combustor well into the furnace is to shorten the structure of the concentric pipes 21 between the rotary steam joint 20 and the combustor header 18. This makes this structure stronger and less subject to possible misalignment.

We claim as our invention:

1. A rotary combustor for buring municipal solid waste comprising, in combination, a plurality of pipes secured together to define an inner generally cylindrical surface, means mounting said plurality of pipes for rotation about the axis of said cylindrical surface with the axis being tilted so as to have a high and a low end, said pipes at said low end being formed so that said generally cylindrical surface becomes frustoconical towards said low end and the lower portion of said frustoconical surface tilts in the direction of said axis but at a lesser angle so that a larger diameter end of said frustoconical surface is contiguous with said cylindrical surface and a smaller diameter end of said frustoconical surface is lower than a lower edge of said larger diameter end of the frustoconical surface; means for rotating said plurality of pipes about said axis, means for circulating water through said pipes, and means for feeding municipal solid waste in the high end of said surface, said pipes being secured so as to define a plurality of intermediate openings so that said cylindrical and frustoconical surfaces are gas porous to provide a rotary combustor adapted for burning municipal solid waste.

2. The combination of claim 1 in which said intermediate openings on said frustoconical surface increase in size from said cylindrical surface to said low end.

3. The combination of claim 1, wherein the slope of the lower edge of the frustoconical surface is generally 2 degrees less than horizontal when proceeding from the large to the small diameter ends thereof.

4. A structure for burning material and generating steam comprising, in combination, a plurality of combustor pipes secured together to define an inner generally cylindrical surface, means mounting said plurality of combustor pipes for rotation about the axis of said cylindrical surface with the axis being tilted so as to have a high end and a low end, said lower portion of said pipes being formed so that said generally cylindrical surface becomes frustoconical with a larger diameter end of said frustoconical portion being contiguous with the cylindrical portion and a smaller diameter end of the frustoconical portion being lower than the lower edge of the larger diameter end of the frustoconical portion a plurality of boiler pipes defining a furnace having a side opening, said combustor pipes extending through said opening so that said low end is well within the furnace, and means securing said combustor pipes together and defining thereby a plurality of intermediate openings so that said generally cylindrical and frustoconical surfaces are gas porous.

5. The combination of claim 4 in which said intermediate openings in said frustoconical surface increase in size from said cylindrical surface to said low end.

6. The combination of claim 4 in which that portion of said combustor pipes extending into said furnace is tapered into a frustoconical configuration.

* * * * *